United States Patent [19]

Verhaeghe et al.

[11] 4,311,193

[45] Jan. 19, 1982

[54] SERPENTINE FIN HEAT EXCHANGER

[75] Inventors: Robert C. Verhaeghe; Homer D. Huggins, both of Racine, Wis.

[73] Assignee: Modine Manufacturing Company, Racine, Wis.

[21] Appl. No.: 167,815

[22] Filed: Jul. 14, 1980

[51] Int. Cl.[3] ..... F28D 1/04

[52] U.S. Cl. ..... 165/149; 165/153

[58] Field of Search ..... 165/149, 152, 153, 164; 29/157.3 B

[56] References Cited

U.S. PATENT DOCUMENTS

| | | | |
|---|---|---|---|
| 2,035,403 | 3/1936 | Przyborowski | 165/165 |
| 2,651,505 | 9/1953 | Freer | 165/152 |
| 2,814,470 | 11/1957 | Peterson | 29/157.3 R |
| 2,869,222 | 1/1959 | Whistler, Jr. | 165/153 X |
| 3,003,749 | 10/1961 | Morse | 165/152 |
| 3,237,688 | 3/1966 | Huggins | 29/157.3 B |
| 3,426,176 | 2/1969 | Simon | 29/157.3 B |
| 3,521,707 | 7/1970 | Brown | 165/152 |
| 3,939,908 | 2/1976 | Chartet | 165/152 |

*Primary Examiner*—Sheldon J. Richter

*Attorney, Agent, or Firm*—Wegner, Stellman, McCord, Wood & Dalton

[57] ABSTRACT

A method of assembling a heat exchanger having spaced fluid flow tubes and a normally flexible serpentine fin in each of the spaces between adjacent tubes in which the normally flexible fin is first assembled in a rigid, easy to handle unit by first attaching a heat conducting, elongated, rigid member to each set of serpentine crests on opposite sides of the fin to produce the relatively inflexible assembly in which the serpentine fin is held by the rigid members against bending followed by inserting each assembly between adjacent tubes and securing the assembly to the tubes. The disclosure also includes the heat exchanger assembled in this manner.

11 Claims, 10 Drawing Figures

Fig. 1.
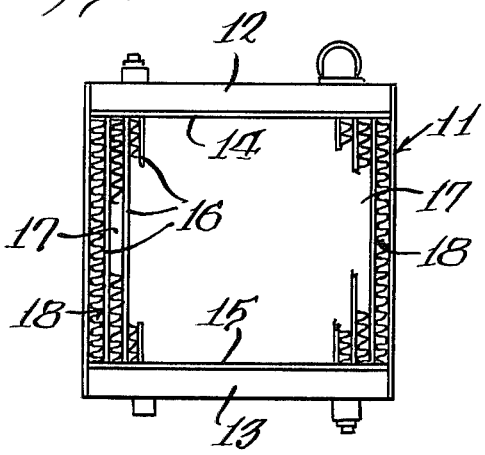
Fig. 2. (PRIOR ART)
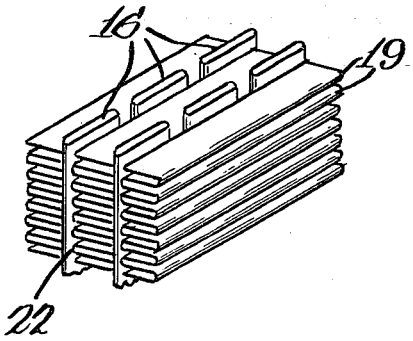
Fig. 3. (PRIOR ART)
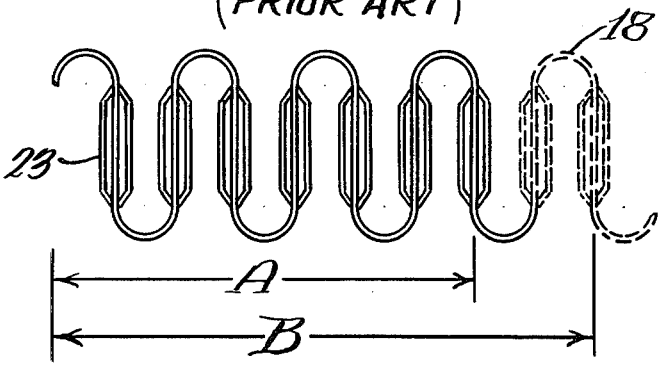
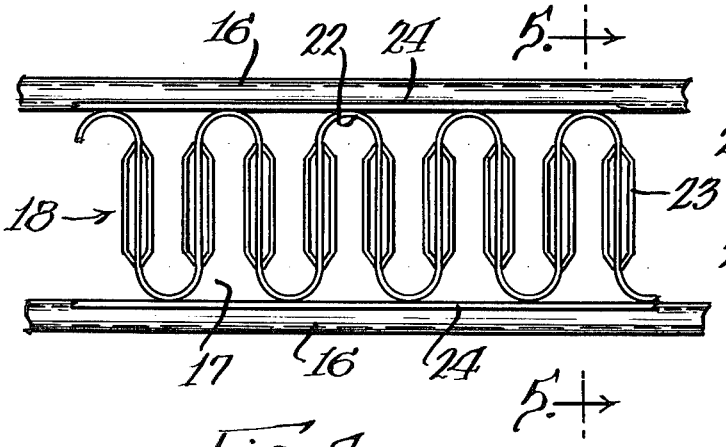
Fig. 4.
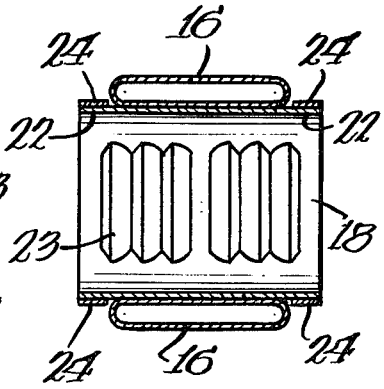
Fig. 5.

SERPENTINE FIN HEAT EXCHANGER

BACKGROUND OF THE INVENTION

A heat exchanger of the automotive type in which spaced parallel coolant tubes extend between a pair of header tanks for conveying the coolant through the tubes from one tank to the other and with the space between adjacent tubes being spanned by serpentine fins is a common construction used not only in automotive equipment but in other types of heat exchangers.

The difficulty in assembling such a exchanger is that serpentine fins which are normally made of very thin metal such as aluminum are so flexible that they are hard to handle in making the heat exchanger. By the method of this invention each flexible serpentine fin is first assembled in a rigid unit by attaching the heat conducting members to the opposite crests of the fin so that the assembly of the fin and rigid members is inflexible and can easily be inserted into the space between adjacent tubes and attached in heat conducting relationship to the tubes.

In the completed heat exchanger these rigid members that are attached to the crests of the serpentine fin are also formed of heat conducting material such as metal of the order of aluminum, steel and the like so that these members themselves contribute to the heat exchange efficiency of the heat exchanger.

SUMMARY OF THE INVENTION

In the method of this invention conventional headers, enclosing tanks, and serpentine or undulating fins for positioning between spaced adjacent tubes interconnecting the tanks are assembled together with the usual auxiliary equipment to produce the heat exchanger. In order to overcome the problem of handling the serpentine fins, which are extremely flexible especially when made with the customary thin metal such as aluminum or steel, are preassembled in a rigid unit by interconnecting the crests on at least one side of the fin with a rigid member attached to these crests. The combination of the rigid members attached to the fins at the crests, preferably on opposite sides of the fin, results in a substantially rigid and inflexible unit that can be easily inserted into the space between adjacent tubes and attached to the tubes at the fin crests and at these rigid members.

The resulting heat exchanger has very high heat conducting efficiency because the rigid members are themselves heat conducting so that their attachment to the crests and to the tubes increases heat conducting efficiency between the fins and the tubes.

Prior art discovered in a novelty search consists of U.S. Pat. Nos. 1,049,940; 1,121,541; 2,056,318; 2,145,073; 2,814,470; 2,851,981; 2,869,222; 2,936,517; 3,211,118; 3,273,226; 3,399,444; 3,521,707; 3,808,668; 3,829,945 and 3,960,308. None of these, however, disclose the invention as claimed in any of the appended claims.

BRIEF DESCRIPTION OF THE DRAWINGS

FIG. 1 is a front elevational view of a heat exchanger, specifically an automotive radiator.

FIG. 2 is a fragmentary, perspective view illustrating the assembly of the tubes and serpentine fins of the conventional radiator of FIG. 1.

FIG. 3 is a fragmentary end elevational view of a conventional fin having angled louvers for creating turbulence in the air flow over the fin and tube, improving heat transfer.

FIG. 4 is a fragmentary side elevational view of a first embodiment of the tube and fin combination using the fin of FIG. 3.

FIG. 5 is a cross sectional view taken substantially along line 5—5 of FIG. 4.

DESCRIPTION OF THE PREFERRED EMBODIMENTS

Figure 6:
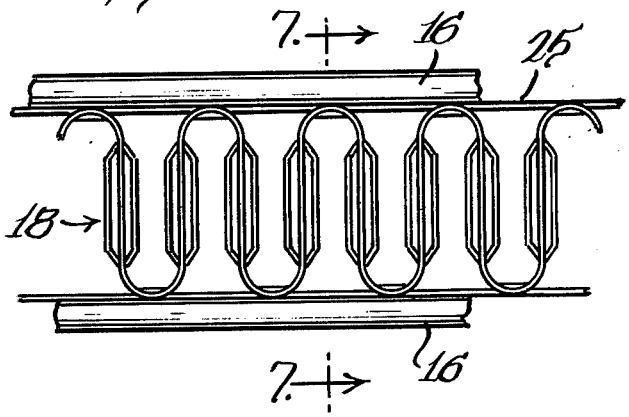
FIG. 6 is a view similar to FIG. 4 but illustrating a second embodiment of the present invention.

In the embodiments illustrated in the drawings FIGS. 1, 2 and 3 represent conventional practice. In FIG. 1 the heat exchanger 11 is of the tube and fin type such as used in automotive radiators and comprises opposite tanks 12 and 13 each having a header plate 14 and 15 through which extend spaced parallel tubes 16 having intervening spaces between adjacent tubes. In the automotive radiator coolant flows between the tanks 12 and 13 by way of the parallel tubes 16 and at the same time a second fluid, in this instance air, flows over the outer surfaces of the tubes 16 and through the intervening spaces 17. In order to aid in heat transfer efficiency these spaces 17 are spanned by serpentine fins 18 each having opposite coplanar crests 19 and 22 attached to the tubes 16 so as to provide efficient heat transfer between the first fluid such as liquid coolant flowing through the tubes 16 and a second fluid such as cooling air flowing between the tubes and over the surfaces of the crests 19.

In the embodiment shown in FIG. 3 each fin 18 is provided with a plurality of angled louvers 23 struck from the fin so as to create turbulence in the second fluid flowing over the fins and thereby improving the heat transfer. Thus FIG. 2 shows a conventional unlouvered fin while FIG. 3 illustrates a conventional louvered fin.

Because the fins 18 are customarily made of very thin metal such as aluminum or steel their extreme flexibility makes assembling the fins 18 in the spaces 17 between the tubes 16 slow and costly. This is because the thin serpentine fins are easily deflected by their own weight and act like resilient springs with the result that it is difficult to guide them into the space between the tubes and retain them in position while they are being soldered, brazed or otherwise permanently attached in heat exchange relationship to the tubes. The method of this invention overcomes this difficulty as the fins are preassembled as a part of a relatively inflexible assembly including the serpentine fin.

This is accomplished by attaching a heat conducting, elongated, rigid member illustrated in the embodiment of FIG. 4 and 5 by the metal straps 24 attached to the crests 22 of a fin 18 on opposite sides of the oval tube 15. This preassembly is produced by soldering, brazing or otherwise attaching the metal straps 24 to the crests.

The resulting substantially inflexible assembly can then easily be inserted into the spaces 17 between adjacent tubes and permanently attached to the tubes as by brazing or soldering.

If desired, the metal straps 24 may be attached to the crests 22 by a resin adhesive such as one containing an epoxy resin and then permanently attaching the straps to the fins in the same brazing or soldering operation that the fins are attached to the tubes 16.

This method of preassembling the serpentine fins and the rigid interconnecting members illustrated by the straps 24 reduces the time of assembly and thereby the cost of producing the radiator by a considerable amount. This is easily understood especially when it is considered that in a conventional heat exchanger of this type the fins are normally only about 0.001 inch to 0.003 inch thick which makes them extremely flexible. Their very weight tends to distort them so that they act like springs and are quite difficult ordinarily to insert into the spaces 17.

The difficulty of assembling such a conventional fin is illustrated graphically in FIG. 3. In this Figure the dimension A illustrates the desired fixed dimension necessary to assemble the fin into a radiator between fixed dimensions between the headers 14 and 15. Dimension B which is greater illustrates the free length of the fin before assembly and therefore before inserting into the spaces 17 between the tubes 16. Thus in this instance the fin must be squeezed from dimension B down to dimension A and held at dimension A while inserting into the radiator core assembly. Without some means of fixing the fin length the dimension between A and B will vary and this will add to the difficulty in assembling the fins within the spaces 17.

FIGS. 4 and 5 illustrate one method of providing a preassembly in which rigid members stiffen the fin so that the fin can be held to a fixed and inflexible dimension while being inserted. In this embodiment four straps 24 of metal, preferably of the same thickness as the fin 18, are bonded to the crest 19 before inserting the fin. As shown, the four are arranged in two pairs with each pair being on opposite sides of a tube 16 and bonded to the fin crests 22.

Figure 7:
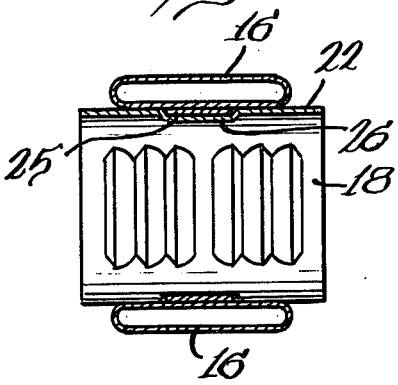
FIG. 7 is a sectional view taken substantially along line 7—7 of FIG. 6.

In the embodiment of FIGS. 6 and 7 only a single metal strap 25 is used and this is located between the tube 16 and the fin crests 22. The outer surface of the strap 25 is against the adjacent surface of the tube 16 and in order to provide room for this single strap without distorting the tubes 16 the fin crests are provided with an embossment 26 directed inwardly and of a depth substantially equal to the thickness of the strap 25.

In each of the embodiments of FIGS. 4–5 and 6–7 a round wire could be used attached to the fin crests instead of the flat straps 24 and 25.

Figure 8:
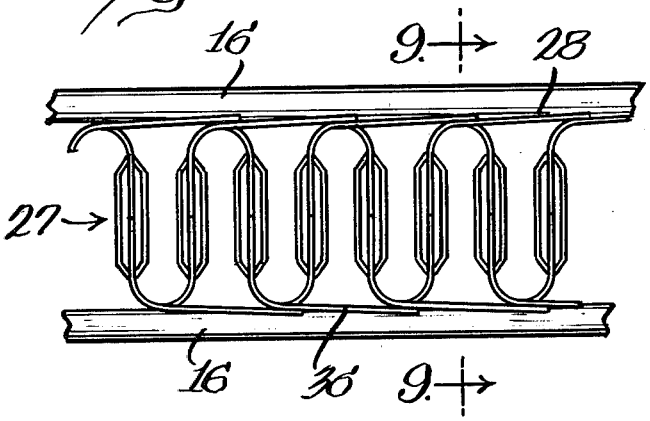
FIGS. 8 and 9 are similar to FIGS. 6 and 7 but illustrating a third embodiment of the invention.
Figure 9:
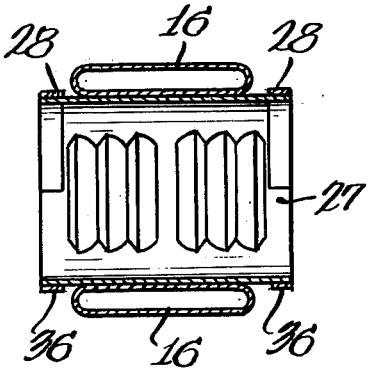
Figure 10:
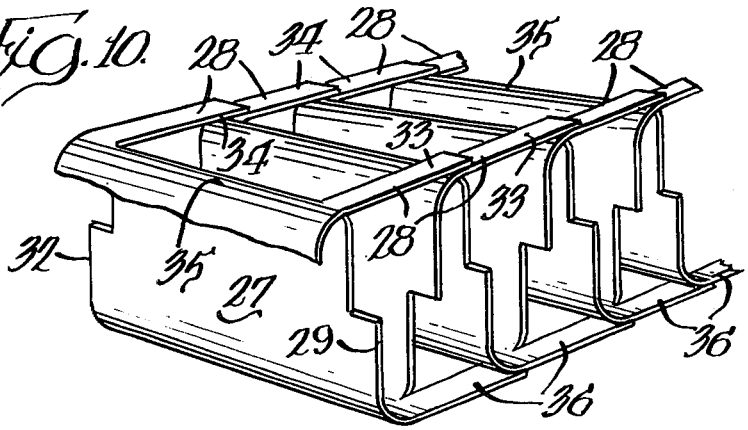
FIG. 10 is a fragmentary perspective view of the fin only of the embodiment of FIGS. 8 and 9.

FIGS. 8–10 illustrate yet another embodiment of the invention. In this embodiment the serpentine fin 27 has edge tabs struck from the side edges 29 and 32 with each set of tabs 28 having a free end 33 and 34 on the opposite edges of the fin 27. These free ends are arranged in overlapping sets as shown in FIG. 10 and attached to each other and to the fin crests 35. In this embodiment the rigid assembly is provided without requiring added members such as the straps 24 and 25. Thus in this embodiment the tabs 28 themselves when assembled as shown at 33 and 34 provide the heat conducting elongated rigid members at each set of crests of the fin.

As is illustrated in FIG. 10, the one set of tabs 28 are struck from one side of the serpentine fin while the opposite set of tabs 36 are struck from the opposite side of the fin 27.

In the embodiment of FIGS. 8–10 no added material is required such as the straps of the preceding embodiments because the tabs are struck from the fin itself. In this latter embodiment the fin can be very easily produced because the tabs 28 and 36 could be formed as the fin comes from the shaping machine, arranged in overlapping configuration as illustrated in FIG. 10 and secured to the fin, all in very simple operations. Thus as the fin comes from the fin machine with the tabs 28 and 36 the fin would be compressed to the fixed dimension as illustrated at A of FIG. 3 and heat and solder applied to the fin to attach the tabs 28 and 36 in position to hold this dimension.

In all embodiments the fin could be precoated with solder, if desired, and the assembly be merely heated for remelting the solder and forming the solder joint between the stiffening members whether the straps 24 and 25 or the tabs 28 and the fin crests.

If desired, a single tab 28 or 36 could be formed from an intermediate portion of the fin to correspond to the single strap 25 shown in FIGS. 6 and 7.

Having described our invention as related to the embodiments shown in the accompanying drawings, it is our intention that the invention be not limited by any of the details of description, unless otherwise specified, but rather be construed broadly within its spirit and scope as set out in the appended claims.

We claim:

1. A heat exchanger, comprising:

spaced tubes for a first heat exchange fluid;

a rigid assembly comprising a serpentine fin of thin and flexible heat conducting metal having opposite sets of crests attached in heat exchange contact with an adjacent pair of said tubes and extending across the space between said tubes for contact with a second heat exchange fluid; and an elongated, heat conducting, rigid member in addition to said tubes attached to each said set of crests.

2. The heat exchanger of claim 1 wherein said tubes are arranged substantially parallel to each other and attached to opposite fluid header tanks for flow of said first fluid between said tanks by way of said parallel tubes.

3. The heat exchanger of claim 1 wherein said heat conducting rigid member comprises a flat strap attached to said crests.

4. The heat exchanger of claim 3 wherein said strap is of substantially the same thickness as the tubes and the serpentine fin.

5. The heat exchanger of claim 3 wherein there are provided a pair of said straps for each set of crests with said pair being on opposite sides of a said tube.

6. The heat exchanger of claim 3 wherein there is provided a single strap positioned between a tube and the said set of crests.

7. The heat exchanger of claim 6 wherein said single strap is positioned in an embossment in each crest of said set and transverse to said crest.

8. The heat exchanger of claim 7 wherein each said embossment is elongated and of a depth substantially equal to the thickness of the strap.

9. The heat exchanger of claim 1 wherein said elongated rigid member comprises at least one round wire.

10. The heat exchanger of claim 1 wherein said rigid member comprises a set of tabs struck from the opposite edges of the serpentine fin and having free ends, the free ends of the tabs on each side of the fin being overlapping and attached to the next adjacent said crest.

11. The heat exchanger of claim 10 wherein each said set of tabs are substantially coplanar and closely adjacent to a said tube.

* * * * *